United States Patent [19]

Yamaura

[11] Patent Number: 4,770,008

[45] Date of Patent: Sep. 13, 1988

[54] PLASTIC WATCHBAND

[75] Inventor: Junichi Yamaura, Shioziri, Japan

[73] Assignee: Hattori Seiko Kabushiki Kaisha, Tokyo, Japan

[21] Appl. No.: 48,288

[22] Filed: May 11, 1987

[30] Foreign Application Priority Data

May 12, 1986 [JP] Japan ..... 61-70841[U]

[51] Int. Cl.[4] ..... A44C 5/02; A44C 5/14

[52] U.S. Cl. ..... 63/3; 224/175; 59/80; 59/900; 59/90; 63/DIG. 3

[58] Field of Search ..... 63/4, 5 R, 11, 3, 9; 59/80, 90, 79.1, 900; 224/254, 267, 175, 164, 178, 219

[56] References Cited

U.S. PATENT DOCUMENTS

| | | | |
|---|---|---|---|
| 2,775,093 | 12/1956 | Kundert | 63/4 X |
| 2,807,928 | 10/1957 | Wills | 59/80 |
| 4,609,786 | 9/1986 | Omoto | 63/5 R |

FOREIGN PATENT DOCUMENTS

| | | | |
|---|---|---|---|
| 0217465 | 4/1987 | European Pat. Off. . | |
| 2254352 | 5/1974 | Fed. Rep. of Germany . | |
| 547945 | 9/1956 | Italy | 63/5 R |
| 814329 | 6/1959 | United Kingdom | 59/900 |
| 882948 | 11/1961 | United Kingdom . | |

*Primary Examiner*—Richard J. Johnson

*Attorney, Agent, or Firm*—Blum Kaplan

[57] ABSTRACT

A plastic watchband made of individual links, having greater variety in design and secureness of fit is provided. The plastic watch band is joined of a plurality of separate links, each link having an engagement projection on one platform for engaging an enjoining link through an engagement opening on another platform of an adjacent link. A flexible intermediate member is provided between the platforms. The intermediate region is angled relative to the platforms so that the engagement opening is offset relative to the engagement projection.

11 Claims, 2 Drawing Sheets

FIG. 1
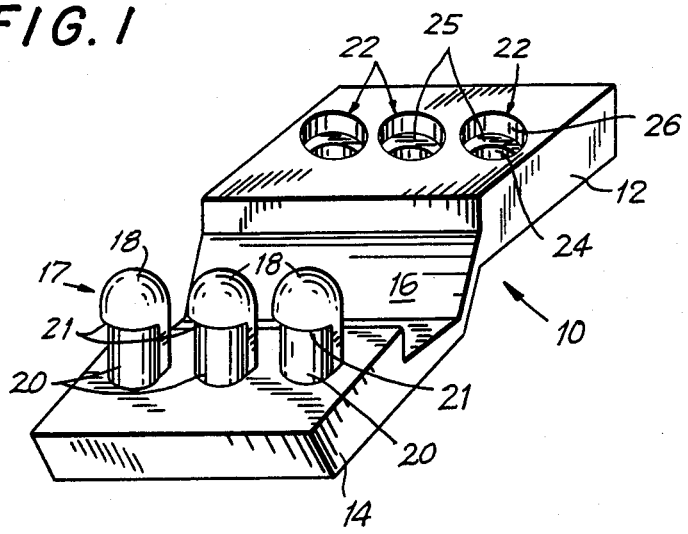
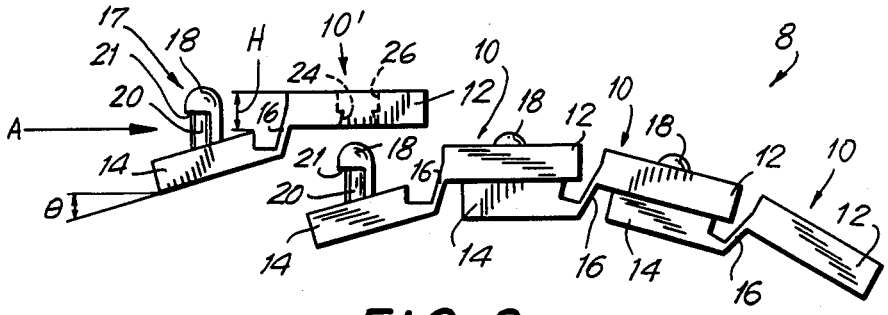
FIG. 2
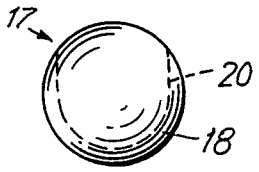
FIG. 3
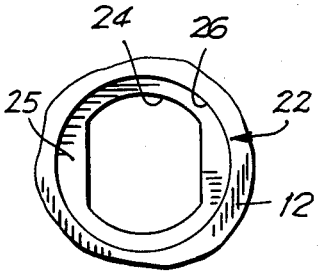
FIG. 4

PLASTIC WATCHBAND

BACKGROUND OF THE INVENTION

This invention relates in general to watchbands, and in particular to watchbands formed of plastic.

Plastic watchbands are known in the art. These prior art watchbands are generally a unitary band body formed by injection molding of plastic resins, such as urethanes. These prior art watchbands have been satisfactory, however, they suffer from inherent limitations of an injection molded product. The prior art watchbands cannot be easily formed with variations in color, patterns or in design. Furthermore, injection molding does not lend itself to providing a watchband which securely fits a variety of different sized wrists. Accordingly, it is desirable to provide an improved watchband made of plastic which overcomes the shortcomings of the prior art devices described above.

SUMMARY OF THE INVENTION

Generally speaking, in accordance with the invention, a watchband providing a wide variation in design and correctness of fit is provided. The watchband includes a series of links, each link formed with a first platform having at least one engaging projection and a second platform connected to the first platform and formed with at least one engaging opening. Each engaging projection of one link is inserted through the engaging opening of an adjoining link so that a series of links are successively joined to each other to form a watchband of a desired length. To provide greater curvature and insure a better fit about the wrist, the platforms are offset at an angle from each other by a flexible intermediate section of the link.

Accordingly, it is an object of the invention to provide an improved watchband.

Another object of the invention is to provide a plastic watchband having a greater variation in design.

A further objection of the invention is to provide a plastic watchband having a greater secureness of fit.

Still other objects and advantages of the invention will in part be obvious and will in part be apparent from the specification and drawings.

The invention accordingly comprises features of construction, combination of the elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is perspective view of a watchband link constructed and arranged in accordance with the invention;

FIG. 2 is a side elevational view of several of the watchband links of FIG. 1 successively engaged to form the watchband;

FIG. 3 is a top plan view of an engaging projection of the watchband link of FIG. 1;

FIG. 4 is a plan view of an engaging opening of the watchband link of FIG. 1;

DETAILED DESCRIPTION OF THE PREFERRED EMBODIMENTS

Figure 5:
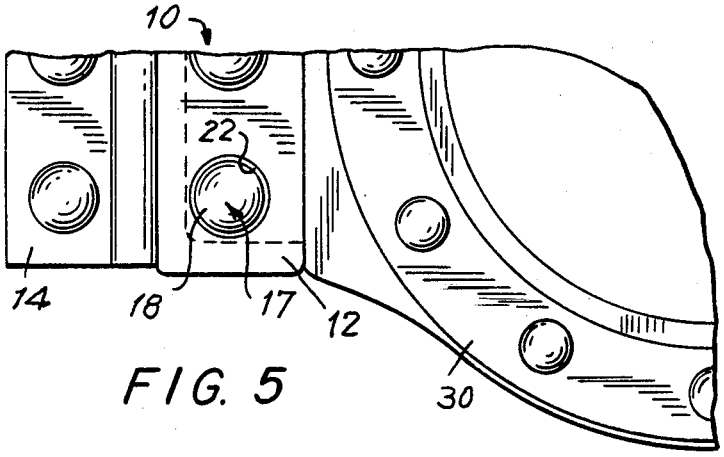
FIG. 5 is a partial top plan view of a watchband link secured to the watchcase.

Reference is made to FIGS. 1-4, wherein a watchband generally indicated as 8 formed of a plurality of inter-connected links 10 constructed in accordance with the invention is shown. Link 10 is formed with a first substantially planar platform 12 and a second substantially planar platform 14. Platform 12 is joined to platform 14 by a flexible intermediate region 16 which is disposed at an angle relative to both platform 12 and platform 14. By this arrangement, the plane of platform 14 is offset from platform 12 by an angle and a distance H.

In the illustrated embodiment, three substantially cylindrical engaging projections 17 are integrally formed on platform 14. Each engaging projection 17 extends from platform 14 at an angle corresponding to angle $\theta$ so that projections 17 are substantially perpendicular to platform 12. Projection 17 is formed with a cylindrical base 20 with a rounded head 18 at the top which is undercut at a lip 21 so that base 20 has a diameter less than that of rounded head 18. Lip surface 21 is at an angle so that lip surface 21 is substantially parallel to the plane of platform 12. Base 20 is formed by a slide mold structure which moves in a sliding direction indicated by arrow A in FIG. 2.

Three engaging openings 22 are formed through platform 12 in a direction substantially parallel to projections 17. Each opening 22 is formed with a maximum diameter of opening equal to or slightly greater than the maximum diameter of projection 17 and a lower portion 24 inclined for receiving engaging projection 17 and an upper portion 26 having a circular shape of constant diameter along its entire length. The maximum diameter of upper portion 26 is slightly greater than the maximum diameter of projection 17. The minimum diameter of lower portion 24 is slightly greater than the minimum diameter of base 20 of projection 17 and less than the maximum diameter of projection 17. A shoulder 25 is formed by the difference in diameters of the upper portion 26 and lower portion 24.

Watchband 8 is formed from a plurality of links 10 joined together in succession. Each engagement projection 17 of link 10 is inserted through engaging opening 22 of a second link 10'. When inserted, engagement head 18 is positioned within upper portion 26 of engaging opening 22. As discussed above, engagement head 18 has a diameter larger than the minimum diameter of lower portion 24, therefore, lip 21 contacts shoulder 25 securing projection 17 within engaging opening 22. The angled surface of lower portion 24 of engaging opening 22 facilitates the passing of the larger diameter engagement projection 17 through engaging opening 22. Simultaneously, the minimum diameter region of lower portion 24 engages base 20 of projection 17. When engagement projection 17 is secured within engaging opening 22, platform 14 comes into contact with platform 12 in a substantially flush manner.

Intermediate region 16 is thinner than either platform 12 or platform 14. This provides a hinged effect so that even when links 10 are molded from a hard plastic, such as a polyacetal resin flexibility in the watchband is provided. When combined with the inclination angle of platform 14 relative to platform 12, and the offset distance H between platform 14 and platform 12, the thickness of watchband 8 remain uniform while providing the necessary elasticity to watchband 8 to provide a better fit for a variety of different wrist sizes.

The difference in diameter between projection base 20 and projection top 18 facilitates the coupling and uncoupling of successive watchband links to each other. This further provides for variety of in design due to the interchangeability of links of different colors, shapes, as well as number of engaging projections and engagement openings. In the present embodiment, three engagement openings and three engagement projections are used by way of example only. The number may change to provide a variety of designs, as well as rotatability when a single projection is used.

Figure 6:
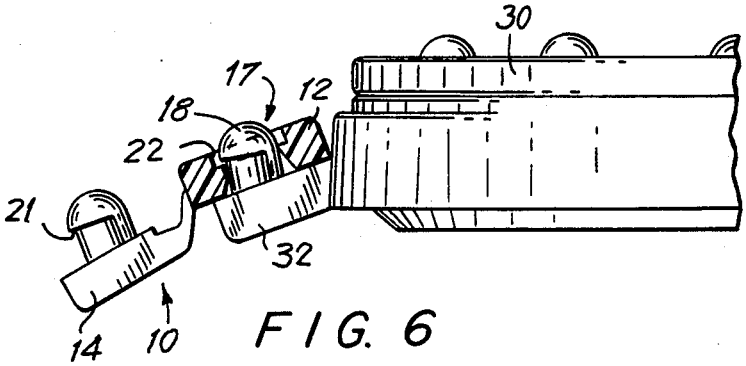
FIG. 6 is a side elevational view of the watchband link secured to the watchcase taken along line 6—6 of FIG. 5.

Reference is now made to FIGS. 5 and 6 wherein a portion of a watchcase 30 formed with an integral platform 32 is shown. Platform 32 is offset by an angle $\alpha$ which may be the same or different than angle $\theta$ shown in FIG. 2. Platform 32 supports a plurality of engaging projections 17 extending perpendicularly therefrom as in links 10 shown in FIG. 2. The last link 10 of watchband 8 is affixed at its projecting head 17 to the remainder of the plurality of links 10 and engaging openings 22 receive each engagement projection 17 platform 32. Again, engagement head 18 is positioned within engaging opening 22 and due to the larger diameter of engagement head 18 secures projection 17 with an engaging opening 22. The angled surface of platform 32 allows for flush mating with platform 12 of link 10. This engagement process is repeated on the opposite side of watchcase 30. Therefore, a plurality of links 10 is engaged on either side of case 30 to form a complete wristwatch having a watchband 8. Projection 17 on platform 32 is used by way of example only. An opening 22 may be substituted on platform 32 for projection 17 to mate with a projection 17 of the last link 10 of watchband 8.

Figure 7:
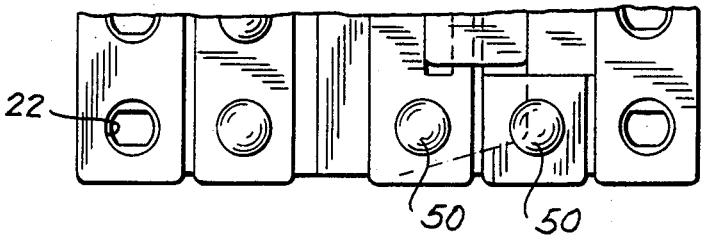
FIG. 7 is a partial plan view of a clasp for engaging the watchband.
Figure 8:
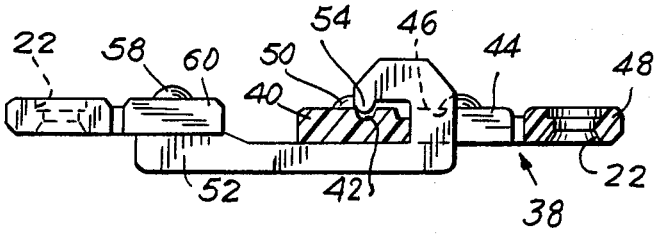
FIG. 8 is a partial sectional view of the clasp of the watchband of FIG. 7.

Reference is now made to FIGS. 7 and 8 wherein a clasp assembly 60 for selectively closing watchband 8 in accordance with the invention is shown. FIG. 7 is a partial plan view and FIG. 8 is a side elevational view.

Clasp assembly is provided at the ends of watchband 8 not secured to case 30 to secure watchband 8 about the wrist of the user. A female buckle generally indicated as 38, has a first platform 40 integrally formed with a second platform 44 which in turn is integrally formed with a third platform 48.

Third platform 48 has an opening 22 therein for receiving a projection 17 of an adjacent link 10 of the bracelet portion of watchband 8. Second platfrom 38 contains a bore 46 for receiving a male buckle 52 therein. First platform 40 has a notch 42 for receiving a hook 54 of male buckle 52, thereby securing male buckle 52 within second platform 44 of the female buckle 38 portion of clasp assembly 60 to prevent inadvertent unhooking. Buckle 38 is provided with projections 50 to give buckle 38 an appearance similar to that of links 10 when they are engaged with each other. Projections 50 resemble projection top 18 as seen when projecting through an opening 22. Therefore, a unity of appearance is provided throughout watchband 8.

Male buckle 52 is integrally formed with a platform 60 which contains an opening 22 therethrough for engaging a projection 17 of link 10 of watchband 8. Platform 60 is also provided with a projection 58 to provide a unity of appearance with the remainder of watchband 8. Watchband 8 is secured to the wrist of the user by inserting male buckle 56 through bore 46 of female buckle 38 and sliding nose 54 into notch 42 thereby selectively securing male buckle 56 within female buckle 38.

Providing a watchband having a clasp assembly in accordance with this aspect of the invention has several advantages. The similarity in construction presents a uniform appearance. Additionally, it provides the ability to adjust the size of the watchband easily and provides a secure closure.

Accordingly, by providing a watch band made of a plastic material which is constructed of a number of links each having an engagement projection and an engagement opening formed on separate platforms, each link being successively joined to another link to form a watch band, a plastic watch band may be constructed of a variety of designs. By providing an angled flexible intermediate region between the engagement opening and the engagement projection of each link a better fitting plastic watch band is obtained.

It will thus be seen that the objects set forth above, among those made apparent from the preceding description are efficiently obtained and since certain changes may be made in the above construction without departing from the spirit and the scope of the invention, it is intended that all matters contained in the above description or shown in accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A watchband formed of a plastic material, comprising a plurality of interlocking band elements, each element formed with at least one engaging projection and at least one receiving opening, the engaging projection adapted to be operatively engaged by the receiving opening in an adjacent element to retain the projection therein for forming the watchband, each band element including a first substantially planar platform and a second substantially planar platform, the engaging projection formed on the first platform, and the receiving opening formed on the second platform, the platform being joined by an intermediate portion wherein the intermediate portion is flexible; and wherein the intermediate region is formed at an angle relative to the first and second platforms for forming a watchband of relatively uniform width.

2. The watchband of claim 1, wherein the projection is integrally formed with the first platform and extending therefrom.

3. The watchband of claim 2, wherein the engaging projection is substantially cylindrical and extends from the first platform at an angle and includes a base and a top, the top having a diameter greater than the diameter of the base forming a lip, the projection being adapted to cooperate with the corresponding receiving openings.

4. The watchband of claim 1, wherein the receiving opening is an opening extending through the second platform.

5. The watchband of claim 4, wherein the upper portion of the receiving opening has a diameter greater than the diameter of the top of the corresponding engaging projection, the base portion of the opening having a diameter greater than the diameter of the top of the projection and the intermediate region of the opening has a diameter less than the top of the projection for forming a shoulder at the intersection of the upper and intermediate portions so that the lip of the projection rests on the shoulder to be engaged thereby when the projection is inserted into the opening to couple adjacent elements.

6. The watchband of claim 5, wherein the base of the projection is formed by a slide mold structure.

7. An interlocking element for forming a bracelet of a plastic material, comprising:

a first substantially planar platform and a second substantially planar platform, the first platform and the second platform being joined by a flexible intermediate member;

at least one receiving opening extending through the second platform;

at least one engaging projection integrally formed with the first platform and extending therefrom, the projection having a base and a top, the top having a diameter greater than the diameter of the base for forming a lip, the projection being adapted to be operatively engaged by the receiving opening in an adjacent element to retain the projection therein for forming the bracelet;

the intermediate member being at an angle relative to the first platform and the second platform so that the plane of the first platform is offset relative to the plane of the second platform;

the upper portion of the receiving opening having a diameter greater than the diameter of the top of the engaging projection, the lower portion of the opening having a diameter greater than the diameter of the top of the projection and the intermediate region of the opening having a diameter less than the top of the projection for forming a shoulder at the intersection of the upper and intermediate portions so that the lip of the projection engages the shoulder of the projection when the projection is inserted into the opening thereby selectively engaging the adjacent element having the projection.

8. A bracelet formed of a plastic material comprising:

a plurality of interlocking bracelet elements each element including;

a first substantially planar platform and a second substantially planar platform, the first platform and the second platform being joined by a flexible intermediate member;

at least one receiving opening extending through the second platform;

at least one engaging projection integrally formed with the first platform and extending therefrom, the projection having a base and a top, the top having a diameter greater than the diameter of the base for forming a lip, the projection is adapted to be operatively engaged by the receiving opening in an adjacent element to retain the projection therein for forming the bracelet;

the intermediate member being at an angle relative to the first platform and the second platform so that the plane of the first platform is offset relative to the plane of the second platform for providing a substantially uniform curved surface of adjacent elements; and the upper portion of the receiving opening has a diameter greater than the diameter of the top of the engaging projection, the lower portion of the opening having a diameter greater than the diameter of the top of the projection and the intermediate region of the opening has a diameter less than the top of the projection for forming a shoulder at the intersection of the upper and intermediate portions so that the lip of the projection engages the shoulder of the projection when the projection is inserted into the opening thereby selectively engaging the adjacent element having the projection.

9. A watchband formed of a plastic material, comprising a plurality of interlocking band elements, each element with at least one engaging projection and at least one opening, the engaging projection adapted to be operatively engaged by the receiving opening in an adjacent element to retain the projection therein for forming the watchband and a watchcase formed with an engaging projection adapted to be operatively engaged by the receiving opening in an adjacent element.

10. The watchband of claim 9, wherein the watchcase is formed with a platform extending therefrom and the projection is formed on the platform.

11. A watchband formed of a plastic material, comprising a plurality of interlocking band elements, each element formed with at least one engaging projection and at least one receiving opening, the engaging projection adapted to be operatively engaged by the receiving opening in an adjacent element to retain the projection therein for forming the watchband; and a selectively openable and closeable clasp assembly, the clasp assembly including a male member operatively engageable with the last element on one side of the watchband and a cooperating female member operatively engagable with the last element on the opposite side of the watchband; and wherein the male member includes an upwardly projecting hook having a downwardly facing tip for engaging the female member and the female member is formed with an opening for receiving the hook and an adjacent notch for engaging the downwardly facing tip of the hook to secure the clasp in a closed position.

* * * * *